US011771947B2

(12) United States Patent
Christ

(10) Patent No.: US 11,771,947 B2
(45) Date of Patent: Oct. 3, 2023

(54) FOLDING ATHLETICS MAT WITH MAGNETIC ASSEMBLY

(71) Applicant: Levigato, LLC, Mount Pleasant, SC (US)

(72) Inventor: Nicholas Christ, Mount Pleasant, SC (US)

(73) Assignee: Levigato, LLC, Mount Pleasant, SC (US)

( * ) Notice: Subject to any disclaimer, the term of this patent is extended or adjusted under 35 U.S.C. 154(b) by 0 days.

(21) Appl. No.: 17/189,512

(22) Filed: Mar. 2, 2021

(65) Prior Publication Data

US 2021/0275857 A1 Sep. 9, 2021

Related U.S. Application Data

(60) Provisional application No. 62/984,460, filed on Mar. 3, 2020.

(51) Int. Cl.
*A63B 21/00* (2006.01)

(52) U.S. Cl.
CPC ..... *A63B 21/4037* (2015.10); *A63B 2210/52* (2013.01)

(58) Field of Classification Search
CPC ..... A63B 21/4037; A63B 2210/52; A63B 2209/08; A63B 2210/50; A63B 71/00; A47G 27/0231; A47G 27/0237; A47G 9/062; A47G 27/04; A47G 27/0412; A47G 2200/106; A44B 99/00; A44D 2203/00

See application file for complete search history.

(56) References Cited

U.S. PATENT DOCUMENTS 3,744,483 A * 7/1973 Picolin ..... A61H 7/001 4/581
4,330,892 A * 5/1982 Fukushima ..... A47G 9/1036 5/636
5,096,188 A * 3/1992 Shen ..... A61H 7/001 601/134
5,099,530 A * 3/1992 Scott ..... A47G 9/02 5/500

(Continued)

FOREIGN PATENT DOCUMENTS

CA 144506 U 12/2012
CN 202191633 U 4/2012

(Continued)

OTHER PUBLICATIONS

Notification of Transmittal of the International Search Report and the Written Opinion of the International Searching Authority dated Jun. 3, 2021, in connection with corresponding international Application No. PCT/US21/20613 (10pp.).

(Continued)

*Primary Examiner* — Garrett K Atkinson
(74) *Attorney, Agent, or Firm* — Maier & Maier, PLLC

(57) ABSTRACT

A foldable athletics mat for use in yoga, Pilates, and the like which is provided with split joints which facilitate folding and allow for a greater selection of candidate materials for one or more surfaces of the mat, sweat channels to transport perspiration away from a practitioner, and magnetic fasteners for securing the mat when mat is folded into a folded position.

20 Claims, 6 Drawing Sheets

(56) References Cited

U.S. PATENT DOCUMENTS 5,195,197 A * 3/1993 Gutierrez ..... A47C 27/002 5/500
6,430,766 B1 * 8/2002 Henley ..... A47C 27/20 5/730
6,591,764 B1 * 7/2003 Dean ..... A63F 1/06 108/90
7,955,683 B1 * 6/2011 Ferrell ..... A63B 57/60 15/209.1
D660,068 S * 5/2012 Wang ..... D6/582
D674,225 S * 1/2013 Boyer ..... D6/582
8,510,878 B2 * 8/2013 Wang ..... A47G 27/0237 5/419
8,822,012 B2 * 9/2014 Franks ..... A63B 6/00 428/156
9,211,437 B2 * 12/2015 Soba ..... A63B 21/151
D762,399 S * 8/2016 Sorrick ..... D6/582
9,950,208 B2 * 4/2018 Willis ..... A63B 21/4037
2004/0250346 A1 * 12/2004 Vasishth ..... A47G 27/0237 5/420
2007/0233506 A1 * 10/2007 Moore ..... G06Q 50/265 705/325
2007/0275827 A1 * 11/2007 Glaser ..... A63B 21/4037 482/148
2008/0005947 A1 * 1/2008 Barna ..... A63B 69/3661 40/629
2008/0124509 A1 * 5/2008 Boise ..... G06F 3/0395 428/45
2010/0072794 A1 * 3/2010 Karovic ..... A47C 7/62 297/188.2
2011/0072581 A1 * 3/2011 Villa ..... A63B 21/4037 5/420
2012/0076981 A1 * 3/2012 Franks ..... A63B 6/00 5/420
2012/0227181 A1 * 9/2012 Cintas ..... A47G 27/0237 112/475.08
2012/0233772 A1 * 9/2012 Wang ..... A63B 21/4037 5/417
2012/0260421 A1 * 10/2012 DeGregorio ..... A47G 27/0237 53/473
2013/0190151 A1 * 7/2013 Scholder ..... A63B 21/4039 482/142
2014/0068858 A1 * 3/2014 Wambeke ..... A47G 9/062 5/420
2014/0335319 A1 * 11/2014 Tsai ..... A63B 21/4037 428/172
2015/0007777 A1 * 1/2015 Nonoguchi ..... A01K 1/0157 119/161
2015/0113739 A1 4/2015 Pollett et al.
2015/0128349 A1 5/2015 Padilla et al.
2015/0351524 A1 * 12/2015 Martinez ..... D05B 15/00 112/475.08
2016/0059066 A1 * 3/2016 Willis ..... A63B 21/4037 5/417
2016/0332023 A1 * 11/2016 Taylor ..... A47K 10/02
2017/0080278 A1 * 3/2017 Wiggins ..... A47K 10/02
2017/0095690 A1 * 4/2017 Sharkey ..... A47G 27/0237
2017/0105563 A1 * 4/2017 Dawson ..... D06N 7/0071
2017/0266485 A1 * 9/2017 Willis ..... A63B 71/0036
2017/0291059 A1 * 10/2017 Lin ..... A63B 21/4037
2017/0319896 A1 * 11/2017 Kramer ..... A47G 27/0237
2018/0266021 A1 * 9/2018 Kalati ..... D03D 7/00
2018/0296014 A1 * 10/2018 Carter ..... A63B 71/00
2019/0099654 A1 * 4/2019 Sobalvarro ..... A63B 21/4037
2019/0116904 A1 * 4/2019 Popoca Perez ..... A41F 9/002
2019/0135490 A1 5/2019 Munoz
2019/0350318 A1 * 11/2019 Levine ..... A63B 21/4037
2020/0086513 A1 * 3/2020 Ambielli ..... B25F 1/04
2021/0353997 A1 * 11/2021 Gupta ..... A63B 21/4037
2022/0001231 A1 * 1/2022 Fiducia ..... A63B 21/4037

FOREIGN PATENT DOCUMENTS

CN 206463410 U 9/2017
CN 209809387 U 12/2019
CN 211885108 U 11/2020
JP 3139139 U 1/2008
KR 20-2011-0005147 U 5/2011
KR 10-2012-0110954 A 10/2012
KR 20-2017-0003591 U 10/2017

OTHER PUBLICATIONS

Nicholas Christ, "A Fitness Mat That's Foldable, Portable, Stackable,and Durable Enough for All Your Workouts", Kickstarter, 28pp., retrieved Jun. 14, 2021 from URL: https://www.kickstarter.com/progjects/levigato/levigato-fitness-mats.

* cited by examiner

FOLDING ATHLETICS MAT WITH MAGNETIC ASSEMBLY

BACKGROUND

The present invention relates to the field of foldable athletics mats and/or pads, specifically those used for yoga or Pilates.

Practitioners of yoga often use athletics mats to prevent the slipping of hands and feet. This is especially important for asana practice, where a practitioner must maintain a yoga posture or pose for an extended period of time.

Slipping of the hands and feet is often made problematic due to perspiration of the practitioner. Perspiration may occur at varying degrees due to the fitness of the practitioner, the intensity or duration of a session, or the environment in which the exercise takes place. Bikram Yoga especially, also known as hot yoga, is conducted in environments which are intentionally made hot and humid, which results in profuse sweating and perspiration.

Because slipping may cause injury to a yoga practitioner, it is important to reduce this risk. Some athletics mats manage this problem by using materials which maintain traction despite moist conditions, such as rubber or fabric.

Yoga mats are also frequently designed to be portable. Most ubiquitously, yoga mats are rolled into a small bundle and secured with some manner of straps or cords. However, mats rolled in this fashion often frequently result in voids contained at the center of the roll, which leads to packing inefficiencies. The tubular shape of these rolls may also prove problematic depending on how one seeks to store or transport the mat.

These rolled mats often do not lend well to being folded for storage, often due to the nature of the construction or the materials used. Folding and creasing the mat may damage the material or permanently deform the mat, which is not ideal. Without being able to crease the folds, similar inefficiencies in packing remain.

Therefore, the invention disclosed herein seeks to describe a foldable athletics mat which may be stored more efficiently, stored more easily, as well as provide better anti-slip properties than those currently known.

SUMMARY

The present invention describes a foldable athletics mat for use in yoga, Pilates, and the like. The athletics mat is provided with a plurality of split joints which enable the mat to be easily folded and efficiently stored while enabling a wider selection of composing materials. The athletics mat also contains magnetic fasteners which secure the mat in its folded form without the need for additional straps or cords. The athletics mat is further provided with sweat channels which efficiently transport perspiration away from a user to improve the user's grip.

BRIEF DESCRIPTION OF THE FIGURES

Advantages of embodiments of the present invention will be apparent from the following detailed description of the exemplary embodiments thereof, which description should be considered in conjunction with the accompanying drawings in which like numerals indicate like elements, in which.

FIB. 2A is an exemplary embodiment of a side view of a foldable athletics mat, partially folded along the split joints.

Figure 2A:
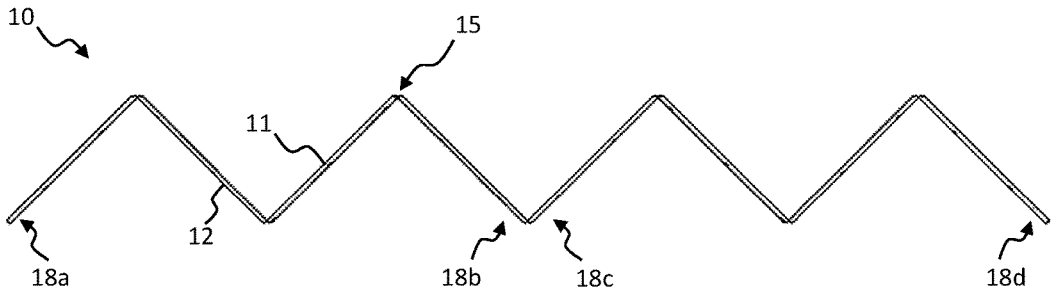
Figure 2B:
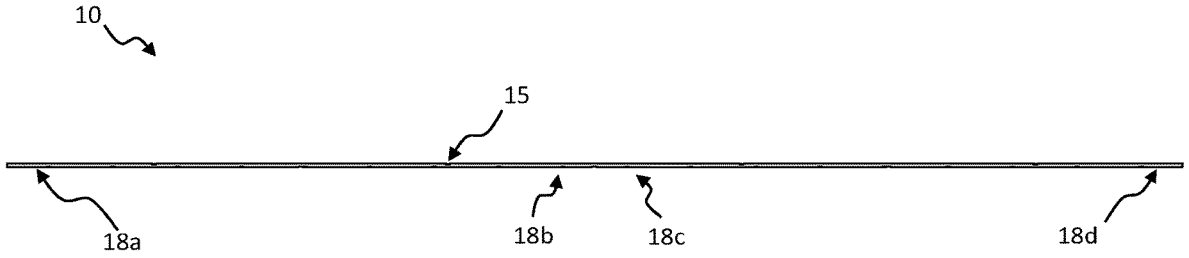

FIG. 2B is an exemplary embodiment of a side view of a foldable athletics mat, laid flat.

Figure 2C:
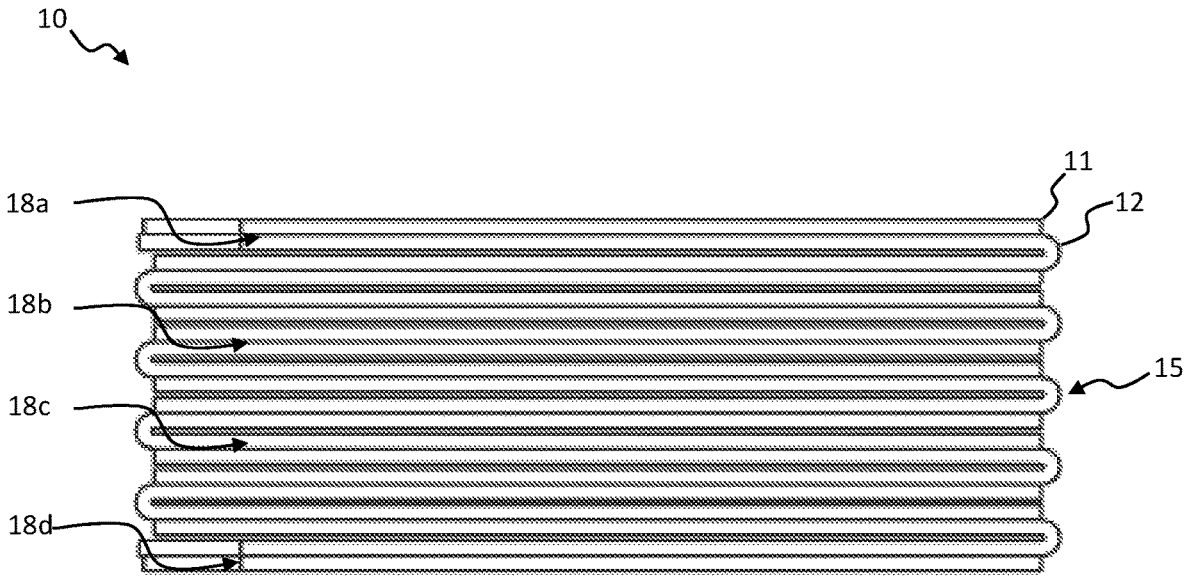

FIG. 2C is an exemplary embodiment of a side view of a foldable athletics mat, fully folded into an accordion-like shape.

Figure 3A:
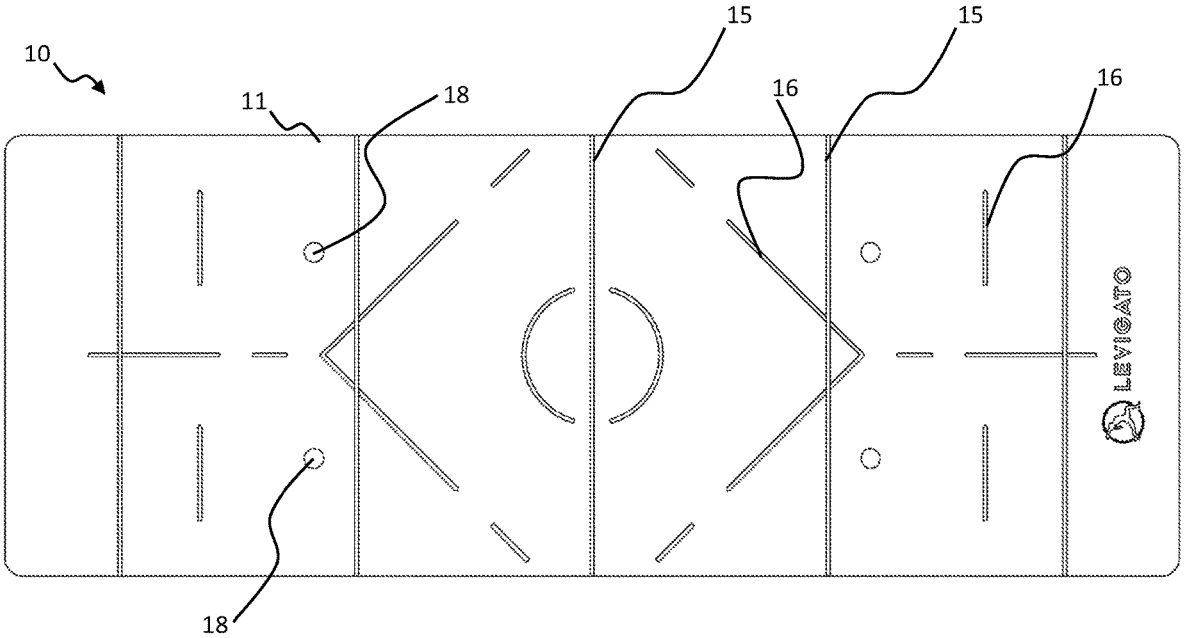

FIG. 3A is another exemplary embodiment of a first face of a foldable athletics mat.

Figure 3B:
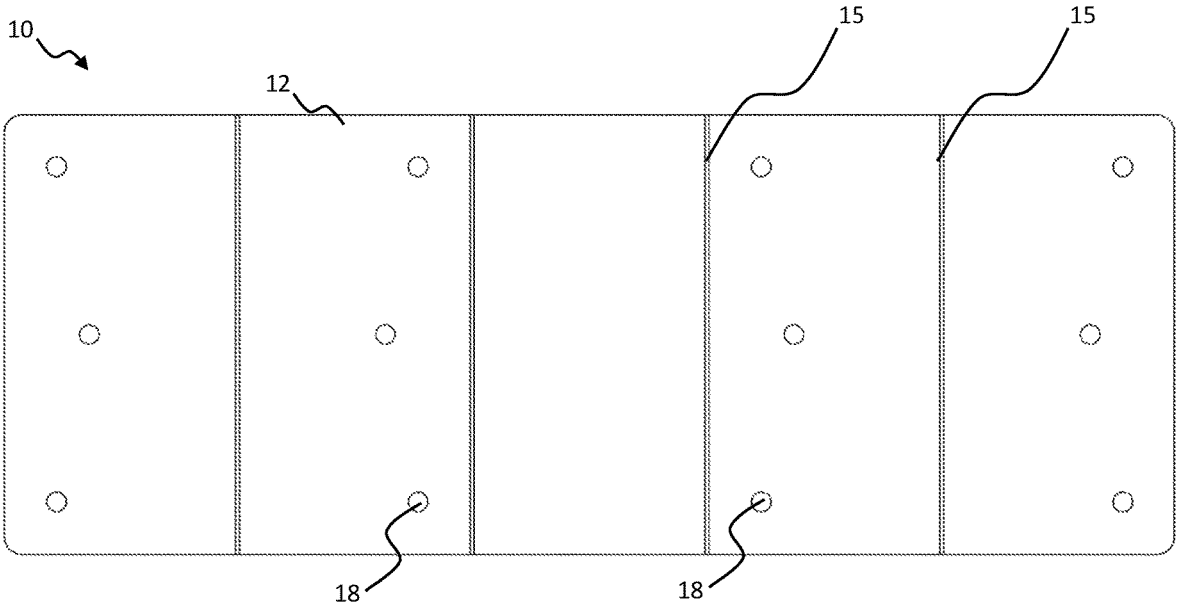

FIG. 3B is another exemplary embodiment of a second face of a foldable athletics mat.

Figure 4:
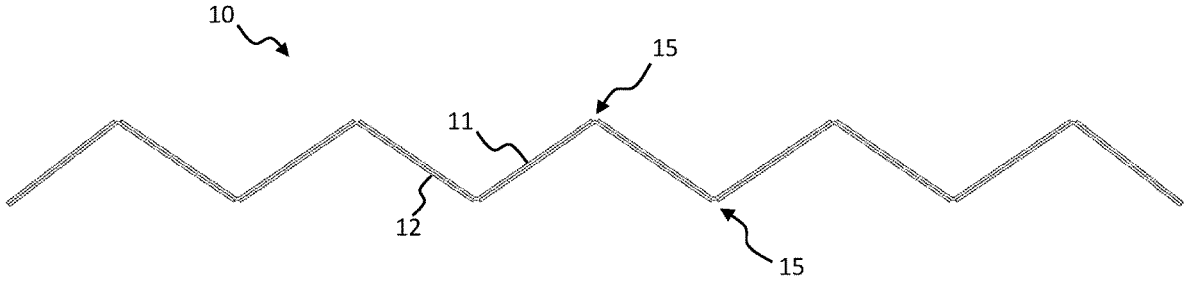

FIG. 4 is another exemplary embodiment of a side view of a foldable athletics mat, partially folded along the split joints.

Figure 5A:
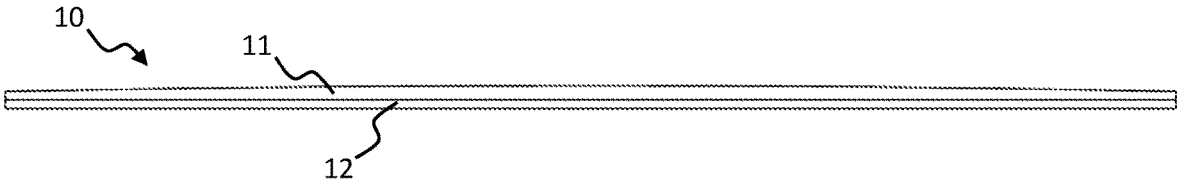

FIG. 5A is another exemplary embodiment of a side view of a foldable athletics mat having a convex surface.

Figure 5B:
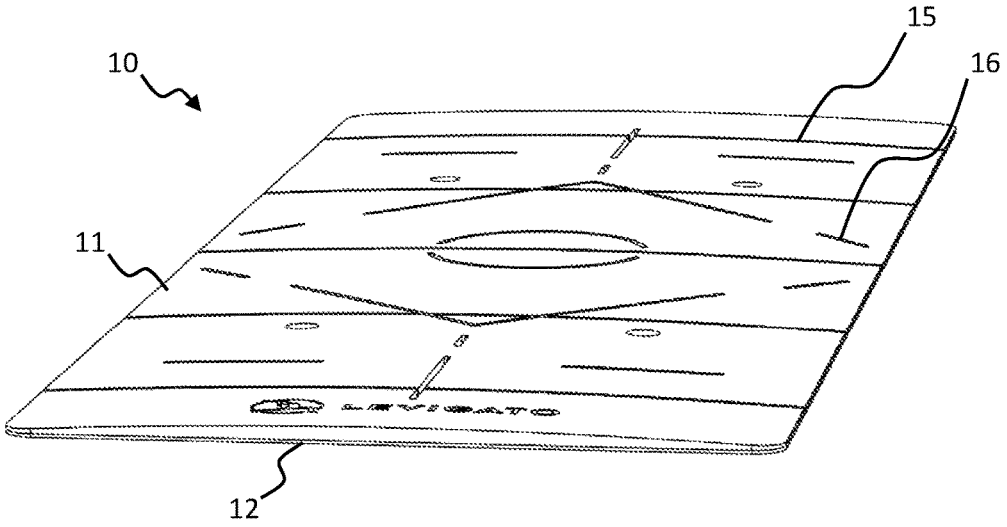

FIG. 5B is another exemplary embodiment of a projected view of a foldable athletics mat having a convex surface.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

Figure 1A:
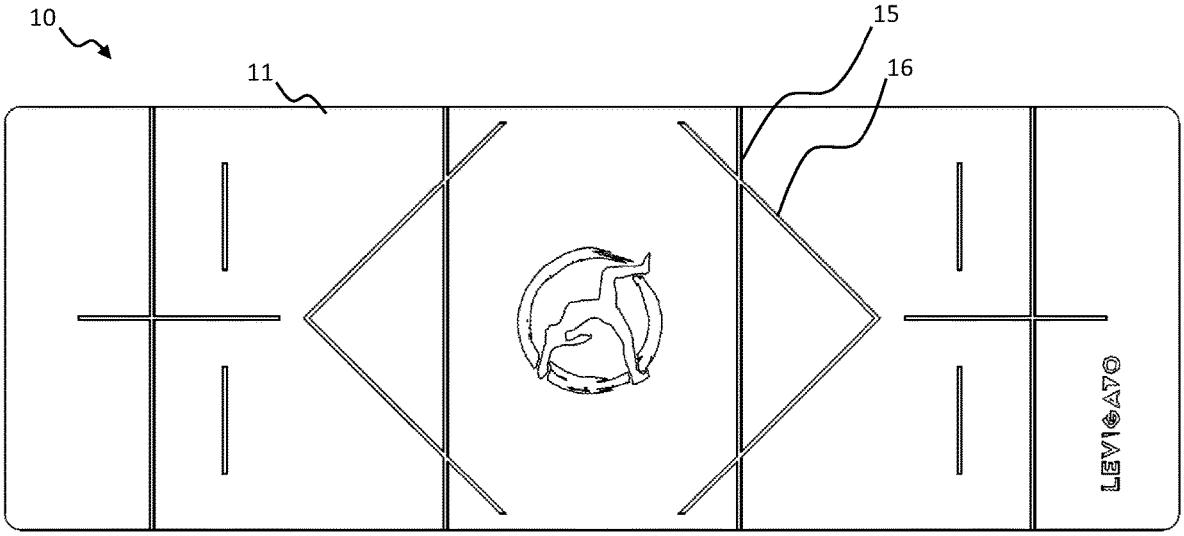
FIG. 1A is an exemplary embodiment of a first face of a foldable athletics mat.
Figure 1B:
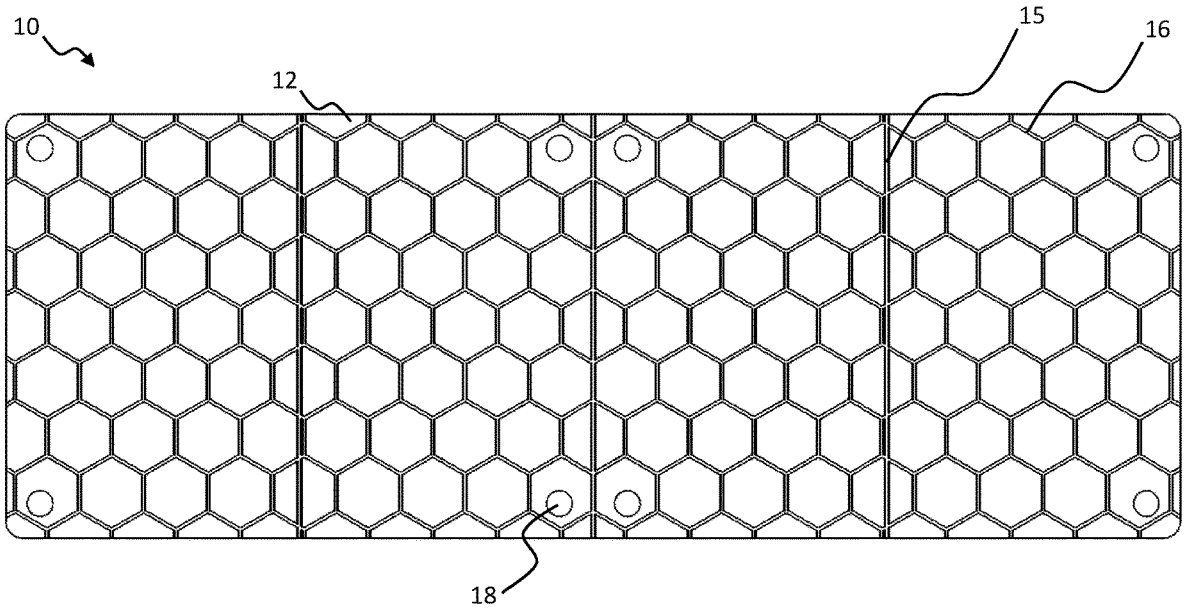
FIG. 1B is an exemplary embodiment of a second face of a foldable athletics mat.

Turning now to exemplary FIGS. 1A and 1B, a foldable athletics mat 10 is shown. FIG. 1A shows a first face 11 of the foldable athletics mat 10, and FIG. 1B shows a second face 12 of the foldable athletics mat 10.

The first face 11 and the second face 12 are typically composed of materials such as rubber, thermoplastics, foam, PVC, vinyl, cotton, jute, or similar. These materials, when varied in type, application, density, and thickness, can provide a variety of properties such as stiffness, stickiness or anti-slip, and sponginess to each face 11, 12.

The first face 11 and the second face 12 may, for example, each be composed of the same material. Alternatively, the first face 11 and the second face 12 may each be composed of the same material, but in different thicknesses, densities, weaves, or the like. In another advantageous embodiment, the first face 11 and the second face 12 may each also be advantageously composed of differing materials in similar thicknesses, densities, and weaves or in differing thicknesses, densities, and weaves.

The first and second faces 11, 12 may also be textured to further adjust the anti-slipping properties of the athletics mat 10, such as with a brushed or roughened finish. In cases where a brushed finished is used, it may be advantageous to apply the finish in a substantially lateral direction or a substantially longitudinal direction with respect to the first or second faces 11, 12. This texture may be incorporated directly into the material of the first or second faces 11, 12, or may be provided via application of a finishing material and/or coating.

The first and second faces 11, 12 may also be configured such that a pattern may be imprinted, cut, molded, or otherwise formed in the face to impart certain qualities into the respective face. Such patterns may be configured to improve comfort of a user when contacting the face, improve traction between either the practitioner and the respective face 11, 12 or the respective face 11, 12 and the floor upon which the face rests, and the like. FIG. 1B depicts an exemplary hexagonal pattern formed in a second face 12 of the athletics mat 10.

The first and second faces 11, 12 may also be configured or formed to have a concave or convex surface. That is to say, the first and/or second faces 11, 12 may be configured or formed so as not to be flat or level when the athletics mat 10 is, for example, laid upon the floor. In one advantageous embodiment, the concave or convex shaping may extend across an entire width or length of the athletics mat 10. In another advantageous embodiment, the concave or convex shaping may instead be localized, such as spanning between one or more split joints 15, one or more sweat channels 16, patterns, or other features formed or cut into the first and second faces 11, 12 of the athletics mat. The concave or convex shaping may be provided to improve the comfort of the mat, such as being locally positioned in places where a practitioner's body is likely to come into contact with the mat. The concave or convex shaping may also be provided to facilitate the flow of sweat or fluids into split joints 15, sweat channels 16, or the like. For example, a sweat channel 16 may be positioned in the trough of a convex shaping, so that fluids are more likely to collect in the sweat channel 16.

The material comprising the first and/or second faces 11, 12 may also be formulated to have hydrophobic and/or anti-microbial qualities. Alternatively, the surfaces of the first and/or second faces 11, 12 may be treated with an appropriate surface treatment or coating material which may impart hydrophobic and/or anti-microbial qualities. For example, before being formed into a first or second face 11, 12 of the mat, the base material may be mixed with certain chemicals or additives such as, for example, polysiloxanes to impart hydrophobic qualities or silver to impart anti-microbial qualities. Alternatively, these chemicals or additives may be applied to the first and/or second face 11, 12 once formed, before or after the first and second faces 11, 12 are bonded together to form an athletics mat 10. The foregoing chemicals or additives are meant to be exemplary in nature only, as one skilled in the art would be knowledgeable as to additional chemicals or additives which are appropriate to mix with or coat the base material of the first and second faces 11, 12 in order to yield the desired hydrophobic and/or anti-microbial qualities.

In this manner, one may advantageously create an athletics mat with a sum total of properties not possible with a single layer of material. One may also advantageously create an athletics mat that has reversible capability, such that a practitioner may use the athletics mat 10 with the first face 11 facing upwards or the second face 12 facing upwards as preferred.

In another exemplary embodiment, the first face 11 may provide a firm surface for the practitioner while the second face 12 provides a soft surface for the practitioner.

The first face 11 and the second face 12 may be bonded directly to one another. Alternatively, the first face 11 and the second face 12 may each be bonded to a middle or intermediate layer provided for additional structural support. This intermediate layer may likewise be varied in material and thickness, density, and weave as with the first and second faces 11, 12.

Provided in the first and second faces 11, 12 are a plurality of split joints 15. The split joints 15 are provided at locations where the athletics mat 10 is intended to be folded. Split joints are positioned on each respective face at locations where, due to the direction of the fold, the material of the face may be in tension. Each split joint 15 may span the entire, or substantially the entire, length or width (as is appropriate) of the athletics mat 10.

For example, when folding the athletics mat 10 in a way that two sections of the second face 12 are brought into direct contact and sandwiched between two sections of the first face 11, the material of the second face 12 would necessarily be in compression about the fold and the material of the first face 11, positioned at an outer surface of the fold, would necessarily be in tension about the fold. To relieve this tension, a split joint 15 is provided so that no stretching of the material of the first face 11 occurs. This may advantageously allow for a wider array of materials to be used, especially those which may easily fatigue or respond negatively to such tension.

In a preferred embodiment, split joints 15 are positioned at various lateral or longitudinal locations along the respective dimension of the athletics mat 10. The first face 11 may, for example, have four such split joints 15 at four different longitudinal locations, and the second face 12 may, for example, have three such split joints 15 at three different longitudinal locations, for a total of seven joints along seven locations enabling seven folds. The seven joints of this exemplary embodiment divide the athletics mat 10 into eight hinged panels which may then be folded accordion-style into a compact shape.

However, it is conceived that any number of split joints 15 may be cut or formed in the athletics mat 10 to enable different folding patterns.

The athletics mat 10 may be further provided with a plurality of sweat channels 16. These channels are cut or formed into the material of the first and/or second faces 11, 12 to allow sweat and perspiration from a practitioner or user to efficiently settle away from points of contact. The sweat channels 16 may be wholly contained by the athletics mat 10 and simply serve as reservoirs in which sweat may accumulate. By accumulating in these lower regions, the impact of sweat on the grip of a practitioner or user on the complementary raised regions can be lowered and the overall grip of the practitioner or user can be improved. The sweat channels may also be cut or formed to the edge of the athletics mat 10, thus allowing sweat to flow off and/or away from the athletics mat 10 by way of the channels thus provided. Again, by allowing sweat to flow away via low regions, the grip of the user or practitioner at the complementing raised regions can be improved.

The split joints 15 provided in the first and second faces 11, 12 may advantageously be cut or formed wider than otherwise necessary so that, when the athletics mat 10 is laid flat, the split joints 15 may also serve as sweat channels 16.

Patterns formed in either the first and second faces 11, 12 may also advantageously be used as sweat channels 16.

The athletics mat 10 may be further provided with one or more magnets 18 which are provided to aid in securing the mat as it is folded. The magnets 18 thus provided are incorporated into the first and/or second faces 11, 12 so as to be flush with the surface of each respective face. For example, a depression may be cut or formed into the second face 12 so that the magnet may be inserted in a flush manner into this depression and secured via adhesive or a fastener—such as a flattened tab, button, or hook—to the material of the first face 11 or the intermediate layer. The magnets 18 are positioned preferably near the side edges of the athletics mat 10, but the magnets 18 may be placed at any place on the athletics mat 10 where practitioner contact is expected to be limited. The magnets 18 may be arranged in varying patterns depending on the fold pattern desired. For example, the magnets may be positioned at four longitudinal positions to enable the athletics mat 10 to be folded into an accordion shape with eight distinct panels, resulting in two magnetically secured portions each comprising four distinct panels.

The magnets 18 may thus be embedded in the first face 11, the second face 12, or both the first and second faces 11, 12. When two magnets 18 are embedded in both the first and second faces 11, 12 at the same location, it may be appropriate to configure the thickness of the magnets and the depth of the depression in the first and second faces 11, 12 so that enough material remains of the first and second faces 11, 12 with which to bond to or anchor the magnets 18. Alternatively, if an intermediate layer is not provided throughout the whole of the athletics mat 10, an intermediate layer may be provided locally to the depression or a cutout to serve as a mounting point for the magnets 18. This local intermediate layer may extend sufficiently between and be bonded to the first and second faces 11, 12 to provide a secure anchoring location for the magnets 18.

Additional magnets 18 may also be arranged on the athletics mat 10 in a way advantageous to accommodate static magnetic field therapy. In this manner, the magnets 18 may be provided specifically in locations where a practitioner is likely to contact the mat, so that the magnetic fields of the magnets 18 may come into contact with or close proximity to the practitioner's or user's body. In doing so, the magnets 18 can correct for imbalances in the magnetic field of the practitioner's or user's body and/or aid in the treatment of pain.

Turning to exemplary FIGS. 2A, 2B, and 2C, a side view of the athletics mat 10 with seven total folds can be seen.

In FIG. 2A, it is shown the athletics mat 10 being folded into, for example, an accordion-type pattern. The first face 11 is provided on the top side, relative to the page, and the second face 12 is provided on the bottom side, relative to the page. Split joints 15 are cut or formed into those faces where each fold may place the face in tension.

The magnets 18 are provided in four longitudinal positions, as in FIGS. 1A and 1B. The magnets are provided such that magnet 18*a* attracts magnet 18*b*, magnet 18*b* attracts magnet 18*c*, and magnet 18*c* attracts magnet 18*d*. In this manner, the folded accordion shape is firmly secured by the magnets and no additional means are required to keep the athletics mat 10 in its folded configuration.

FIG. 2B shows the athletics mat of FIG. 2A lain out flat.

FIG. 2C shows an athletics mat 10 with nine total folds. The first face 11 is provided five split joints 15 and the second face 12 is provided with four split joints. The magnets 18 are provided similarly spaced throughout the mat in order to secure adjacent panels to one another.

It is also noted that magnets need not be located so that each adjacent panel is magnetized to the next. When magnets of sufficient strength are to be used, the attractive forces may penetrate multiple panels of the athletics mat 10. This allows panels to be "skipped" and an overall fewer number of magnets used while still retaining the ability of the athletics mat to be secured in the folded position.

The magnets 18 positioned on either longitudinal end of the athletics mat 10 may also serve to secure the athletics mat 10 to a second and/or third athletics mat. This may be advantageous for further securing stacks of the athletics mats for shipping, as well as provide a benefit when stacks of the athletics mats are displayed for advertising or store display purposes. The magnets 18 thus provided may assist in enabling a stack of athletics mats that is more stable. The magnets 18 may also encourage the athletics mats to be stacked in a more visually appealing manner, as the magnets 18 would encourage the stack to be more orderly fashion without the need for boxes, guides, or the like.

In this manner, for example, magnets 18*a* of a first athletics mat 10 may be attracted to magnets 18*d* of a second athletics mat.

The present invention relates to a foldable athletics according to the preceding disclosure.

The present invention further relates to a method for producing a foldable athletics mat according to the preceding disclosure.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art (for example, features associated with certain configurations of the invention may instead be associated with any other configurations of the invention, as desired).

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A foldable athletics mat, comprising:

a first face configured to contact a user composed of a first material provided opposite of a second face composed of a second material, at least one split joint provided in each of the first face and the second face, about which the foldable athletics mat is foldable, and at least one elongated surface sweat channel disposed across the first face and/or the second face and configured to direct fluid away from a top surface, wherein the at least one elongated surface sweat channel is distinct from the at least one split joint and extends only partially across the first face and/or the second face.

2. The foldable athletics mat according to claim 1, wherein the first face is bonded directly to the second face.

3. The foldable athletics mat according to claim 1, wherein an intermediate layer is provided between the first face and the second face, and the first face and the second face are each bonded to the intermediate layer.

4. The foldable athletics mat according to claim 1, wherein each of the at least one split joints is formed as a gap provided completely through a thickness of whichever of the first face or the second face that serves as an outer face when the foldable athletics mat is folded in an intended folding direction about the respective split joint.

5. The foldable athletics mat according to claim 1, wherein one or more of the at least one elongated surface sweat channel intersects with one or more of the at least one split joint to drain into the one or more of the at least one split joint.

6. The foldable athletics mat according to claim 1, wherein one or more of the at least one elongated surface sweat channel extends to an edge of the foldable athletics mat.

7. The foldable athletics mat according to claim 1, further comprising a plurality of magnets which are embedded in the first face and/or the second face so as to be flush with the top surface of a corresponding face.

8. The foldable athletics mat according to claim 7, wherein the plurality of magnets are positioned about the foldable athletics mat such that, when the athletics mat is folded about the at least one split joints, one or more of the plurality of magnets are brought into close proximity so as to attract one another and secure the foldable athletics mat into a folded position.

9. The foldable athletics mat according to claim 8, wherein one or more of the plurality of magnets are positioned such that, when the foldable athletics mat is stacked with a second foldable athletics mat, one or more magnets of the foldable athletics mat are attracted to one or more magnets of the second foldable athletics mat so as to secure the foldable athletics mat to the second foldable athletics mat.

10. The foldable athletics mat according to claim 7, wherein at least a first of the plurality of magnets is embedded in the first face and at least a second of the plurality of magnets is embedded in the second face.

11. The foldable athletics mat according to claim 7, wherein one or more of the plurality of magnets embedded in the first face are secured to the second face, and/or one or more of the plurality of magnets embedded in the second face are secured to the first face.

12. The foldable athletics mat according to claim 7, wherein an intermediate layer is provided only locally to one or more of the plurality of magnets to secure the one or more of the plurality of magnets between the first face and the second face.

13. The foldable athletics mat according to claim 1, wherein the first material and the second material are the same material.

14. The foldable athletics mat according to claim 1, wherein the first face and/or the second face are provided with a surface texture.

15. The foldable athletics mat according to claim 1, wherein the first material and the second material differ with respect to at least one of: a material choice, a material thickness, a material density, a material weave, and a surface finish.

16. The foldable athletics mat according to claim 1, wherein the at least one split joint is a plurality of split joints which are provided in parallel at longitudinal locations along a length of the foldable athletics mat so that the foldable athletics mat folds into an accordion shape.

17. The foldable athletics mat according to claim 16, wherein a plurality of magnets are embedded in the first face and the second face and provided at longitudinal locations along the length of the foldable athletics mat so that, when folded into the accordion shape, one or more of the plurality of magnets are brought into close proximity so as to secure the foldable athletics mat in the accordion shape.

18. The foldable athletics mat according to claim 1, wherein one or more of the at least one elongated surface sweat channel is curved across the first face and/or the second face.

19. A method for producing a foldable athletics mat, comprising:

provision of a first face composed of a first material and a second face composed of a second material, attaching the first face to the second face, forming at least one split joint in each of the first face and the second face at locations where the foldable athletics mat is intended to be folded in an intended folding direction, and disposing at least one elongated surface sweat channel across the first face and/or the second face to direct fluid away from a top surface, wherein each of the at least one split joints are formed as a gap provided completely through a thickness of whichever of the first face or the second face that serves as an outer face when the foldable athletics mat is folded in the intended folded direction about the respective split joint, and wherein the at least one elongated surface sweat channel is distinct from the at least one split joint and extends only partially across the first face and/or the second face.

20. The method according to claim 19, further comprising:

embedding a plurality of magnets in the first face and/or the second face which are flush with a top surface of the first face and/or the second face, wherein, when folded about the at least one split joints, one or more of the plurality of magnets are brought into close proximity so as to secure the foldable athletics mat into a folded position.

* * * * *